United States Patent [19]

Takahashi et al.

[11] 4,130,686

[45] Dec. 19, 1978

[54] STRAPPING BAND HAVING CORE FORMED FROM A THERMOSETTING RESIN AND A COVERING FORMED FROM A THERMOPLASTIC RESIN

[75] Inventors: Mitsuhiro Takahashi, Yokohama; Tadao Senoo, Hino; Shigeo Minekawa, Minokamo; Toshiharu Hirai, Gifu, all of Japan

[73] Assignee: Ube-Nitto Kasei Co., Ltd., Tokyo, Japan

[21] Appl. No.: 803,306

[22] Filed: Jun. 3, 1977

[30] Foreign Application Priority Data

Jun. 17, 1976 [JP] Japan ..... 51/78202[U]

[51] Int. Cl.[2] ..... B65D 63/10

[52] U.S. Cl. ..... 428/294; 24/16 PB; 24/17 AP; 428/295

[58] Field of Search ..... 24/17 AP, 16 PB; 428/294, 295

[56] References Cited

U.S. PATENT DOCUMENTS

| | | | |
|---|---|---|---|
| 2,680,272 | 6/1954 | Radtke | 24/16 PB |
| 3,012,297 | 12/1961 | Wade | 24/16 PB |
| 3,028,281 | 4/1962 | Karass | 428/294 |
| 3,045,303 | 7/1962 | Wade | 24/16 PB |
| 3,073,004 | 1/1963 | Zeisl | 139/420 |
| 3,118,806 | 1/1964 | Grantham | 428/294 |
| 3,237,255 | 3/1966 | Stanton | 24/16 PB |
| 3,475,264 | 10/1969 | Donaldson | 428/294 |
| 3,622,429 | 11/1971 | Kippan | 428/294 |
| 3,908,571 | 9/1975 | Motsenbocker | 112/441 |
| 3,996,403 | 12/1976 | Gould et al. | 428/295 |

*Primary Examiner*—J. C. Cannon

*Attorney, Agent, or Firm*—Wenderoth, Lind & Ponack

[57] ABSTRACT

In a strapping band comprising a tape-shaped core having continuous reinforcing fibers combined together with a thermosetting resin and an outer layer of thermoplastic resin covering the tape-shaped core, the thermoplastic and thermosetting resins each has polymeric units derived from the same monomer.

8 Claims, 1 Drawing Figure

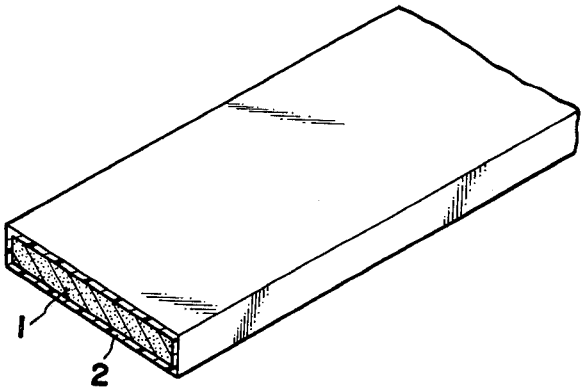
1
2

STRAPPING BAND HAVING CORE FORMED FROM A THERMOSETTING RESIN AND A COVERING FORMED FROM A THERMOPLASTIC RESIN

This invention relates to a strapping band for binding materials.

A strapping band made of polypropylene is widely used for binding materials. However, in such a strapping band, due to the properties of polypropylene, the elongation and the creep thereof are rather high. Accordingly, the strapping bands made of polypropylene have not been suited for use in binding heavy materials which tend to break into pieces such as lumber.

For this reason, a steel band is solely used to bind the heavy materials. The steel band has excellent properties such as high tensile strength, low elongation and low creep. However, the steel band has such disadvantages that a special fastner is required to connect the band ends; the steel is apt to rust; and the cut-out ends thereof are sharp and dangerous. In addition to the disadvantages set forth above, the steel band is relatively heavy and difficult to colour.

Accordingly, an object of the present invention is to provide a strapping band which improves the disadvantages of the polypropylene band and the steel band set forth above.

Another object of the present invention is to provide a strapping band having properties of high tensile strength, low elongation and low creep.

Still another object of the present invention is to provide a strapping band which can be easily and firmly connected with each other at both ends thereof.

According to the present invention, a strapping band is provided which comprises a tape-shaped core having continuous reinforeing fibers combined together with a thermosetting resin, and an outer layer of thermoplastic resin covering said tape-shaped core, wherein said thermoplastic resin and said thermosetting resin each has polymeric units derived from the same monomer.

Preferably, the thermosetting resin is formed by cross-linking an unsaturated polyester resin with styrene and said thermoplastic resin is selected from resins containing units derived from styrene.

The preferable thermoplastic resins may be acrylonitrile-butadiene-styrene copolymer or acrylonitrile-styrene copolymer.

Other objects and features of the present invention will become apparent from the following detailed description of a preferred embodiment thereof when taken in conjenction with the accompanying drawing, in which:

The single drawing is a partially sectioned perspective view showing a part of strapping band according to the present invention.

The present strapping band comprises a thin tape-shaped core 1 in which continuous reinforcing fibers are combined together with a thermosetting resin. Preferable reinforcing fibers are glass fibers from the viewpoint of their excellent physical property and economy. However, other organic reinforcing fibers having high tensile strength such as polyamide fibers, polyester fibers, vinylone fibers, aramide fibers or viscose rayon may be used.

The tape-shaped core 1 is covered with a thin thermoplastic resin layer 2, thereby providing the present strapping band.

According to the present invention, both of the thermosetting and thermoplastic resins are selected to have a chemical affinity with each other in order that both resins may be firmly or integrally combined with each other at the interface therebetween. In a practical example of having the chemical affinity, the thermosetting and thermoplastic resins each has polymeric units derived from the same monomer.

The preferable thermosetting resin is an unsaturated polyester resin containing styrene as vinyl monomer. However, the vinyl monomer contained therein may be vinyl acetate, diallyl phthalate or mixture thereof. The concentration of the monomer in the unsaturated polyester resin is preferably in the range of 20–50%.

The preferable thermoplastic resin is styrene polymer such as ABS (acrylonitrile-butadiene-styrene copolymer) or AS (acrylonitrile-styrene copolymer).

In order to combine or bond the both thermosetting and thermoplastic resins firmly, it is preferable to add functional vinyl monomer such as methacrylate, for example, glycidyl methacrylate to the unsaturated polyester resin.

Reference is now made to one of the methods for forming the present strapping band by using unsaturated polyester as thermosetting resin and ABS (acrylonitrile-butadiene-styrene copolymer) as thermoplastic resin, both of which contain polymeric units derived from styrene monomer and, thereby, have chemical affinity with each other.

First of all, six continuous glass rovings each having weight of 1.1 g/m are drawn from bobbins and arranged substantially in parallel with each other through guide means under substantially equal tension. These glass rovings are then led into a bath which contains 100 parts of unsaturated polyester resin having 30–40% of styrene monomer, four parts of benzoyl peroxide as curing catalyst activated at high temperature, a few parts of additives such as calcium carbonate or Aerosil (trade mark). The resin impregnated glass rovings are then led through a series of shaping dies, whereby they are shaped into a thin narrow tape of 0.4–0.5 mm thick and 12–14 mm wide while superfluous resin is removed as they pass through the dies. Thus shaped resin impregnated glass rovings are then led into an extrusion die. When the glass rovings come out of the extrusion die, molten ABS resin is extruded therefrom around the glass rovings to enclose the latters with the thickness of 0.2–0.3 mm. Thereafter, the resin impregnated glass rovings covered with ABS resin are led into a cooled water bath wherein a pressure is applied from the top and bottom of the ABS resin cover by bars or rollers to firmly combine the ABS resin cover to the resin impregnated glass rovings, thereby forming a continuous tape-shaped semi-product having the thickness of 0.8–1.1 mm and width of 14–20 mm. The ABS resin cover of the semi-product is solidified in the cooled water bath, while the unsaturated polyester resin therein is still uncured. The unsaturated polyester resin is then cured by passing the semi-product through a hot water bath or applying heat by any other heating devices.

In the embodiment set forth above, since the unsaturated polyester resin and ABS resin contain polymeric units derived from styrene monomer, when the molten ABS is covered around the glass fibers impregnated with unsaturated polyester resin, the both resins are firmly and integrally combined with each other by chemical affinity through styrene.

Also, the same effects are obtained in the event that AS (acrylonitrile-styrene copolymer) or other polystyrene resins having high durability against impact is used in place of the ABS resin, since the AS resin and other polystrene resins each contains styrene monomer.

To bind or strap materials such as packages by using the present band, after winding the present band around the packages, both ends of the band are partially laminated with each other and heat is applied to the laminated ends under pressure, whereby the thermoplastic resin forming the outer layers of the laminated band ends is partially molten by the heat and then firmly or integrally combined with each other when cooled after heating.

The present band was subjected to tests to compare the properties thereof with those of the polypropylene heavy-duty band and steel band. The present band comprises glass fibers as reinforcing fibers, unsaturated polyester resin as thermosetting resin and ABS resin as thermoplastic resin cover and formed in accordance with the process set forth above. The band was made to have a width of 15 mm and thickness of 0.8 mm in which the tape-shaped core was made to have a width of 12 mm and a thickness of 0.5 mm. In the tests of bonding strength in the following table, the present band and the polypropylene band were each heat welded with each other at both ends thereof, while the ends of the steel band were connected by a widely used metal fastener. In the tests of durability against impact, six strapping bands were wound around a bale package of synthetic staple fibers of 150 kg and the bale package was dropped from a lift of 5 m height. Numerals in the impact durability test mean the number of bands broken by dropping the packages.

Test Results

| | Present Band | Steel Band | Polypropylene Band |
|---|---|---|---|
| Width (mm) | 15 (12 core) | 19 | 19 |
| Thickness (mm) | 0.8 (0.5 core) | 0.5 | 0.98 |
| Tensile Strength (kg) | 700 | 650 | 460 |
| Bonding Strength (kg) | 600 | 600 | 320 |
| Durability against Impact (Broken Bands/Dropped Packages) | 0/4 | 5/2 | 6/2 |

The bonding strength of the band could be increased up to 650 kg by adding three parts of functional vinyl monomer such as methacrylate to the uncured thermosetting resin of the composition set forth above in the embodiment.

Although it is preferable to bond both ends of the band by heat welding, these band ends can be bonded together by adhesive. In the bonding test, when adhesive of non-solvent type such as denatured acryl or cyanoacrylate was used to bond the both ends of the band, the bonding strength was about 600 kg, which is substantially the same as that obtained by the heat welding.

It has also been noted in another test that when the thermoplastic resin cover of the band is made of polypropylene or polyethylene in place of the present ABS or AS resin in the present embodiment set forth above, the bonding strength of the band was about 50 kg, which is too low to be put into practical use. This is caused by the fact that polypropylene or polyethylene has no polymeric unit derived from styrene monomer and, thereby, has no chemical affinity with the unsaturated polyester in the thermosetting resin.

As can be understood from the above test results and the description set forth hereinabove, according to the present band, the tape-shaped core having the continuous reinforcing fibers combined together with the thermosetting resin bears high tensile strength and low creep property of the band, while the thermoplastic resin cover makes it easy and reliable to combine the both ends of the band firmly and integrally by applying heat under pressure. Also, the tape-shaped core is integrally combined with the thermoplastic resin layer at their interfaces due to the chemical affinity of the thermoplastic resin with the thermosetting resin, whereby both the tape-shaped core and the cover contribute to afford high tensile strength and high bonding strength to the band. That is, the tensile strength and the bonding strength of the present band are substantially equal to or slightly higher than those of the steel band and remarkably higher than those of the polypropylene band. Further, the reinforcing fibers such as glass fibers in the tape-shaped core are covered with thermoplastic resin, so that the reinforcing fibers cannot project outside of the band to pierce the fingers of a worker using this band and, therefore, the binding operation is facilitated.

As in the case of the strapping band subjected to the tests set forth above, in the event the thermosetting resin is unsaturated polyester and the thermoplastic resin is ABS, the band has high durability against impact. Likewise, almost the same high durability of the band is obtained when AS or other polystyrene resins having high durability against impact is used as the thermoplastic resin.

Although the present invention has been described with reference to the preferred embodiments thereof, many modifications and alterations may be made within the spirit of the present invention.

What we claim is:

1. A strapping band comprising a tape-shaped core having continuous reinforcing fibers combined together with a thermosetting resin, and an outer layer of thermoplastic resin covering said tape-shaped core, wherein said thermoplastic resin and said thermosetting resin each has polymeric units derived from the same monomer.

2. A strapping band as claimed in claim 1, wherein said thermosetting resin is formed by cross-linking an unsaturated polyester resin with styrene and said thermoplastic resin is selected from resins containing units derived from styrene.

3. A strapping band as claimed in claim 1, wherein said tape-shaped core has the thickness in the range of about 0.4 to 0.5 mm and width in the range of about 12 to 14 mm, and said outer layer of said thermoplastic resin has the thickness in the range of about 0.2 to 0.3 mm.

4. A strapping band as claimed in claim 1, wherein said reinforcing fibers are several continuous glass rovings arranged in parallel with each other.

5. A strapping band as claimed in claim 1, wherein said thermosetting resin contains functional vinyl monomer therein.

6. A strapping band as claimed in claim 2, wherein said thermoplastic resin is acrylonitrile-butadiene-styrene copolymer.

7. A strapping band as claimed in claim 2, wherein said thermoplastic resin is acrylonitrile-styrene copolymer.

8. A strapping band as claimed in claim 5, wherein said functional vinyl monomer is glycidyl methacrylate.

* * * * *